US009259635B2

(12) United States Patent
Downing

(10) Patent No.: US 9,259,635 B2
(45) Date of Patent: Feb. 16, 2016

(54) PORTABLE GOLF TRAINING SYSTEM

(71) Applicant: SDGI, LLC, Franklin, IN (US)

(72) Inventor: Scott J. Downing, Franklin, IN (US)

(73) Assignee: SDGI, LLC, Franklin, IN (US)

( * ) Notice: Subject to any disclaimer, the term of this patent is extended or adjusted under 35 U.S.C. 154(b) by 0 days.

(21) Appl. No.: 14/496,303

(22) Filed: Sep. 25, 2014

(65) Prior Publication Data

US 2015/0011323 A1 Jan. 8, 2015

Related U.S. Application Data

(63) Continuation-in-part of application No. 13/593,944, filed on Aug. 24, 2012, now Pat. No. 8,870,672.

(60) Provisional application No. 61/949,612, filed on Mar. 7, 2014.

(51) Int. Cl.

| | |
|---|---|
| ***A63B 69/36*** | (2006.01) |
| ***A63B 57/00*** | (2015.01) |
| ***A63B 45/02*** | (2006.01) |
| *A63B 63/00* | (2006.01) |
| *A63B 71/06* | (2006.01) |
| *A63B 71/04* | (2006.01) |

(52) U.S. Cl.

CPC ..... *A63B 69/3676* (2013.01); *A63B 45/02* (2013.01); *A63B 57/0056* (2013.01); *A63B 69/3623* (2013.01); *A63B 63/00* (2013.01); *A63B 71/04* (2013.01); *A63B 2069/3682* (2013.01); *A63B 2071/0694* (2013.01); *A63B 2209/10* (2013.01); *A63B 2210/50* (2013.01)

(58) Field of Classification Search

CPC ..... A63B 57/06; A63B 69/3676; A63B 2071/0694; A63B 69/3667

USPC ..... 473/157–196, 266, 270, 273; 16/45; D21/790

See application file for complete search history.

(56) References Cited

U.S. PATENT DOCUMENTS

| | | | | |
|---|---|---|---|---|
| 2,635,879 A | | 4/1953 | Rath | |
| 3,048,405 A | * | 8/1962 | McCaul | A63B 63/007 473/180 |

(Continued)

OTHER PUBLICATIONS

AdvantageEDGE Pro Putt 360, "pro_putt_360_advantedge_Golfsmith_printout.pdf", printout of webpage "http://reviews.golfsmith.com/8567/30080466/pro-putt-360-precision-targeting-and-alignment-system-reviews/reviews.htm".

(Continued)

*Primary Examiner* — Mark Graham

(74) *Attorney, Agent, or Firm* — Maginot, Moore & Beck, LLPs

(57) ABSTRACT

A golf training system includes at least one target/connecting member having a top wall defining a central opening and a perimeter wall defining a plurality of openings spaced apart from each other about the circumference of the perimeter wall. The target/connecting member is configured to be used as a target by fastening the target/connecting member to the ground using a golf tee or to other surfaces using an integrated anchoring system. Alignment rods are configured to be inserted through the openings in the perimeter wall. Target/connecting members can attach multiple alignment rods together in predetermined configurations for use as golf training aids.

17 Claims, 8 Drawing Sheets

(56) References Cited

U.S. PATENT DOCUMENTS

| | | | | | |
|---|---|---|---|---|---|
| 3,512,262 | A * | 5/1970 | Smyk | A63B 47/008 | 33/555.2 |
| 3,610,632 | A * | 10/1971 | Caldwell | A63B 69/3667 | 473/272 |
| 4,368,888 | A * | 1/1983 | Ren | A63B 57/0056 | 473/164 |
| 5,261,670 | A * | 11/1993 | Mull | A63B 69/3676 | 473/164 |
| 5,275,404 | A | 1/1994 | Dimaano et al. | | |
| 5,282,626 | A * | 2/1994 | Millar | A63B 63/00 | 473/174 |
| 5,435,727 | A * | 7/1995 | Dobson | A63B 69/3667 | 434/252 |
| 5,482,284 | A * | 1/1996 | Vandever | A63B 69/3667 | 33/508 |
| 5,588,653 | A * | 12/1996 | Robinson | A63B 69/3667 | 473/218 |
| D400,631 | S | 11/1998 | Moore | | |
| 6,607,449 | B2 | 8/2003 | McCabe | | |
| 7,052,407 | B2 | 5/2006 | Patterson | | |
| 7,607,987 | B2 * | 10/2009 | Alter | A63B 69/3623 | 473/218 |
| 8,870,672 | B2 * | 10/2014 | Downing | A63B 63/00 | 473/164 |
| 8,951,140 | B1 * | 2/2015 | Kim | A63B 69/3667 | 473/218 |
| 2002/0098902 | A1 * | 7/2002 | Rodriguez | A63B 69/3667 | 473/270 |
| 2007/0135226 | A1 * | 6/2007 | Henderson | A63B 69/3641 | 473/270 |
| 2008/0132348 | A1 * | 6/2008 | Prince | A63B 57/0056 | 473/174 |
| 2009/0176591 | A1 * | 7/2009 | Kershaw | A63B 57/0056 | 473/180 |
| 2013/0053158 | A1 * | 2/2013 | Downing | A63B 63/00 | 473/174 |

OTHER PUBLICATIONS

Nuru Putting Puck, "Nuru_Putting_Puck_Amazon_printout,pdf", printout of webpage "http://www.amazon.com/Nuru-Golf-Putting-Trainer-Training/dp/B001W9CP92".

Putt Pucks Targets, "www_puttpucks_com.pdf", printout of webpage "http://www.puttpucks.com/targets/".

* cited by examiner

PORTABLE GOLF TRAINING SYSTEM

CROSS-REFERENCE TO RELATED APPLICATIONS

This application is a continuation-in-part of U.S. patent application Ser. No. 13/593,944 entitled "PORTABLE GOLF PUTTING TARGET" by Downing filed Aug. 24, 2012 the disclosure of which is hereby incorporated herein by reference in its entirety. This application also claims priority to U.S. Provisional Application Ser. No. 61/526,879 entitled "PORTABLE GOLF PUTTING TARGET" by Downing filed Aug. 24, 2011, U.S. Provisional Application Ser. No. 61/564,900 entitled "PORTABLE GOLF PUTTING TARGET" by Downing filed Nov. 11, 2011, and U.S. Provisional Application Ser. No. 61/949,612 entitled "PORTABLE GOLF PUTTING TARGET" by Downing filed Mar. 7, 2014, the disclosures of which are each hereby incorporated herein by reference in their entirety.

TECHNICAL FIELD

This invention relates to the sport of golf, and, in particular, to golf training aids.

BACKGROUND

Golf requires the ability to swing a variety of different types of golf clubs in a variety of different ways in an effort to produce a desired and consistent result when hitting a golf ball. Each facet of the game of golf, e.g., driving, pitching, chipping and putting, has different aspects, such as stance, grip, ball position, swing tempo, head position, etc., and may require the use of a different type of club. As a result, each facet of the game of golf utilizes vastly different techniques and swing mechanics.

Golf training aids have been developed to help with virtually every aspect of each facet of a golfer's game. However, most training aids are directed to a very specific aspect of one facet of a golfer's game. In addition, different training aids may be designed to help with a particular aspect in different ways. Therefore, a golfer looking to improve in all or a few aspects of a particular facet of golf, such as driving, typically needs to purchase multiple different training aids. A golfer looking to improve in more than one facet of golf would be faced with the prospect of purchasing even more training aids.

A golfer therefore can end up with a large supply of different types and kinds of training aids. A large amount of space may therefore be required just for storing a golfer's training aids. In addition, multiple training aids would typically have to be transported at the same time by a golfer or golf instructor to and from a practice area which can be cumbersome, especially when considering the size and/or complexity of some training aids that are available on the market.

DESCRIPTION

Figure 1:
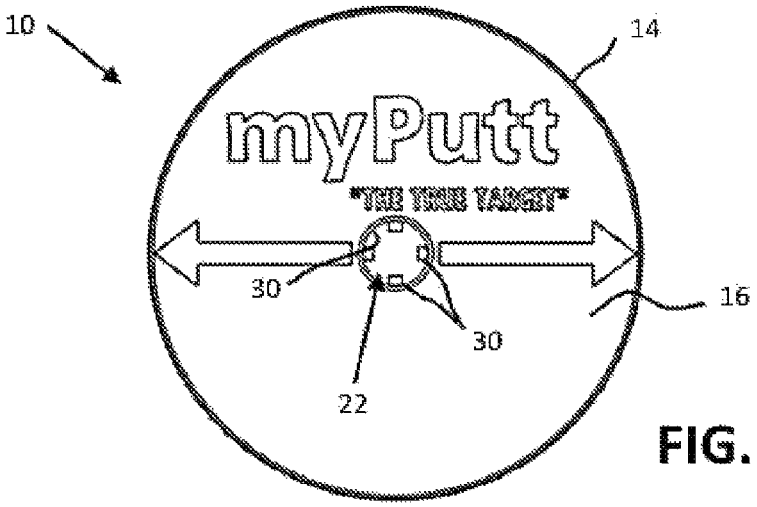
FIG. 1 depicts a top view of an embodiment of a golf training system in accordance with the disclosure.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one of ordinary skill in the art to which this invention pertains.

Figure 2:
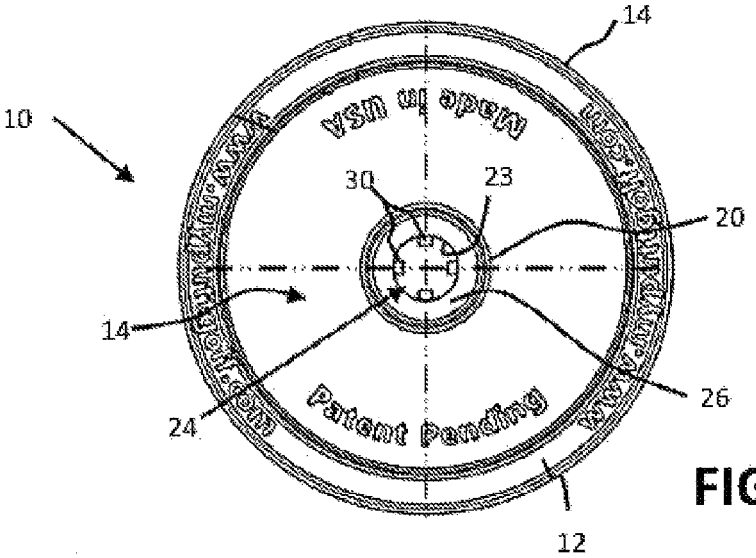
FIG. 2 is a bottom view of the golf training system of FIG. 1.
Figure 3:
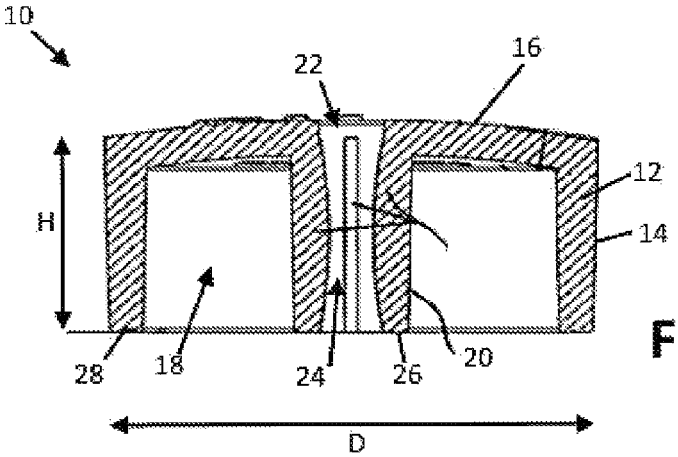
FIG. 3 is a side cross-sectional view of the training system of FIG. 1.

The present disclosure is directed to small, portable, lightweight and inexpensive golf training systems that can be easily carried and that can be used to help with multiple aspects of a golfer's game, thereby reducing the amount of equipment that a golfer or golf instructor would otherwise have to carried and/or purchased. FIGS. 1-3 depict an embodiment of a golf training system in accordance with the present disclosure. As depicted, the golf training system comprises a target/connecting member 10 having a cylindrical perimeter wall 12 with an outer surface 14 and a generally flat top wall 16 with an upper surface 18. The height H of the target/connecting member 10 is defined by the distance between the bottom edge 20 of the perimeter wall 12 and the surface of the top wall 16. The diameter D of the target/connecting member is defined by the outside diameter of the perimeter wall 12.

The height H and diameter D of the target/connecting member 10 are selected to simulate hitting the golf ball at a regulation sized golf cup or hole. More specifically, the target/connecting member 10 is sized so that when a golf ball makes contact with the target/connecting member 10, the center mass of the golf ball is at or inside the diameter of an imaginary golf cup. Thus, putting accuracy can be practiced and improved by putting a golf ball at a target that is smaller than a regulation sized golf cup. In addition, by making contact with the target/connecting member, a golfer receives feedback as to the accuracy of the putts.

The dimensions of the target/connecting member 10 are thus a function of the sizes of a regulation sized golf ball and a regulation sized golf cup. In one embodiment, the target/connecting member 10 has a height H that is approximately half the diameter of a golf ball or greater to allow the target/connecting member to be contacted by the widest diameter portion of the golf ball. The target/connecting member may also have a diameter D that is equal to or less than the difference between the diameter of a golf cup and the diameter of a golf ball. Currently, a regulation sized golf ball has a diameter of approximately 1.68 inches. A regulation size golf cup has a diameter of approximately 4.25 inches. Therefore, in one embodiment, the target/connecting member 10 has a diameter D of approximately 2.57 inches or less. Smaller diameter targets are harder to hit and may be beneficial for professional golfers and other skilled golfers.

The target/connecting member 10 is formed of a lightweight, durable material that is suitable for outdoor use and that is capable of withstanding repeated impacts by golf balls while maintaining its shape. The weight of the target/connecting member 10 is an important consideration in the design. The amount of weight that a golfer or caddie must carry is already significant when considering all of the golf clubs, golf balls, and other items. The use of lightweight materials for the target/connecting member 10 enables the target/connecting member to be extremely lightweight which allows the target/connecting member to be carried in a pocket or added to the golf bag without having an impact on the overall weight carried by a golfer or caddie.

The target/connecting member 10 may be formed a thermoplastic elastomer (TPE) although any suitable material may be used including, for example, foam materials and other lightweight, flexible plastics or polymers. TPE is extremely light weight. In addition to being lightweight, TPE and similar materials are capable of deforming and rebounding in response to contact with a golf ball which can enhance feedback. As used herein, the term "feedback" refers to the ability of the target/connecting member 10 to provide an indication of degree of accuracy as well as the speed of the putt. The rebounding material of the target/connecting member adds energy to the ball that augments the deflection of the ball from the target. A golfer is therefore provided with an enhanced visual indication of how the golf ball was hit based on the degree and angle of deflection.

To further reduce weight and enhance flexibility of target/connecting member, the target/connecting member has a hollow interior 18. The thicknesses of the perimeter wall 12 and top wall 16 are selected to provide the target/connecting member 10 with adequate support for retaining its shape while minimizing weight. The thickness of the walls 12, 16 of the target/connecting member 10 is also at least partially dependent upon the process used in manufacturing the target. In one embodiment, the perimeter wall 12 and upper wall 16 have a thickness of approximately 0.18 inches although any suitable thickness may be utilized.

The top wall 16 of the target/connecting member 10 defines a central opening 22 which can be used to insert a golf tee, or similar type of structure, through the target/connecting member and into the ground. This allows the target/connecting member 10 to be anchored in place during use without having to worry about a successful golf putt knocking it out of position. The opening 22 is sized to allow the head of a golf tee to contact the upper surface when inserted through the target so the tee can hold the target down. Although a single opening 22 is depicted in the center of the top wall 16 of the target/connecting member 10, an opening may be positioned at other locations and/or multiple locations in the top wall.

Figure 4:
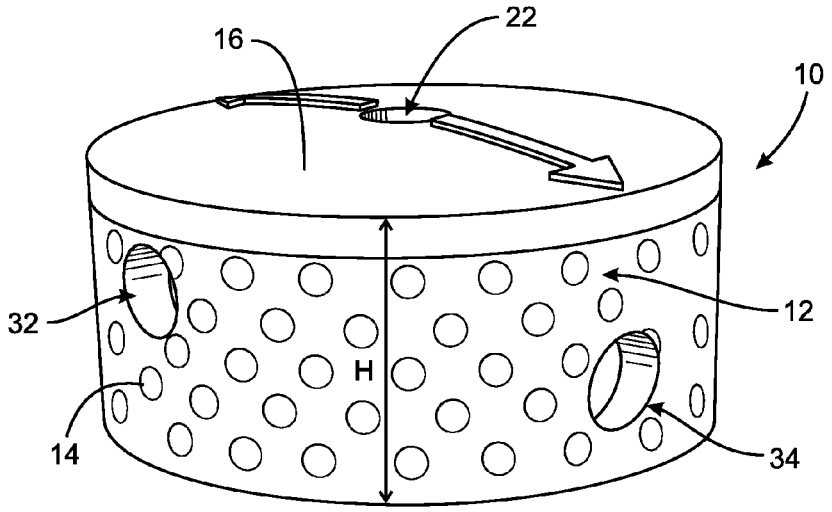
FIG. 4 depicts a top perspective view of another embodiment of a golf training system in accordance with the disclosure.
Figure 5:
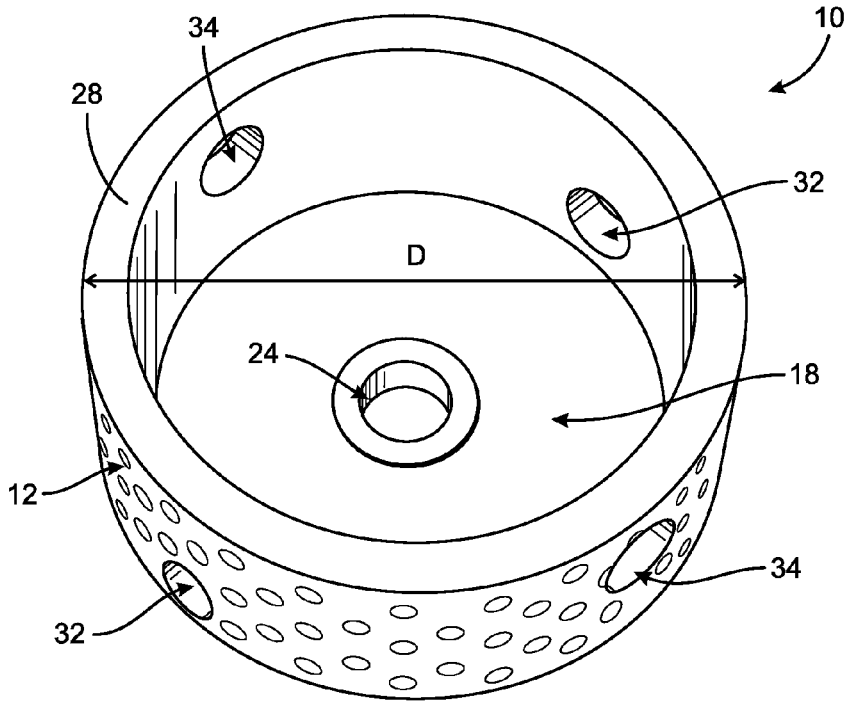
FIG. 5 is a bottom perspective view of the golf training system of FIG. 4.

As can be seen in FIGS. 2 and 3, the target/connecting member 10 may include a tee support portion 20 that extends from the interior surface of the upper wall 16 toward the ground. The tee support portion 20 has a generally cylindrical configuration with an inner wall 23 that defines an open-ended passage 24. In the embodiment of FIGS. 1-3, the tee support portion 20 extends toward the ground a distance that enables the distal end 26 of the tee support 20 to be aligned substantially with the bottom edge 28 of the perimeter wall 12 so that the distal end 26 of the tee support 20 and the bottom edge 28 of the perimeter wall 12 each rest on the surface upon which the target/connecting member is utilized. This allows the tee support 20 to add support to the center portion of the target/connecting member. In alternative embodiments, the tee support 20 can be shortened or attenuated, such as depicted in FIG. 4, which allows greater flexibility in the center portion of the target/connecting member 10 which in turn allows a golf tee to be pressed farther into the ground if necessary to firmly anchor the target/connecting member in position.

The tee support 20 may include tee retaining structures 30 that protrude into the passage 24 from the inner wall 23. The tee retaining structures 30 are configured to frictionally engage the stem portion of a golf tee to releasably retain the golf tee within the passage 24. In one embodiment, the tee retaining structures 30 comprise ribs. The distance that the ribs 30 extend into the passage 24 depends on the width of the passage 24 and the diameter of a golf tee. In one embodiment, the passage 24 has a width or diameter of approximately 0.30 inches, and the ribs 30 extend into the passage from the inner wall 23 a distance of approximately 0.09 inches to define a gap or passage for the tee of approximately 0.21 inches. In other embodiments, the tee retaining structure may have other configurations including more or fewer vertically oriented ribs, such as depicted in FIGS. 2 and 3, or one or more circumferential ribs which extend around the circumference of the passage.

A golf training system may include one or more target/connecting members 10 and one or more alignment rods. Referring to FIGS. 4-7, a target/connecting member 10 may be provided with side openings that enable alignment rods to be inserted through the target/connecting member. The target/connecting member 10 of FIGS. 4-7 has four side openings 32, 34 that extend through the perimeter wall 12 and are spaced apart from each other relative to a circumference of the perimeter wall 12. The openings 32, 34 are evenly spaced apart from each other about the circumference of the perimeter wall, e.g, at 90°, 180°, 270°, and 360°. As a result, a first pair of openings 32 is aligned on a first axis A that passes through the center point of the target 10, and a second pair of openings 34 is aligned on a second axis B that passes through the center point of the target 10.

Figure 6:
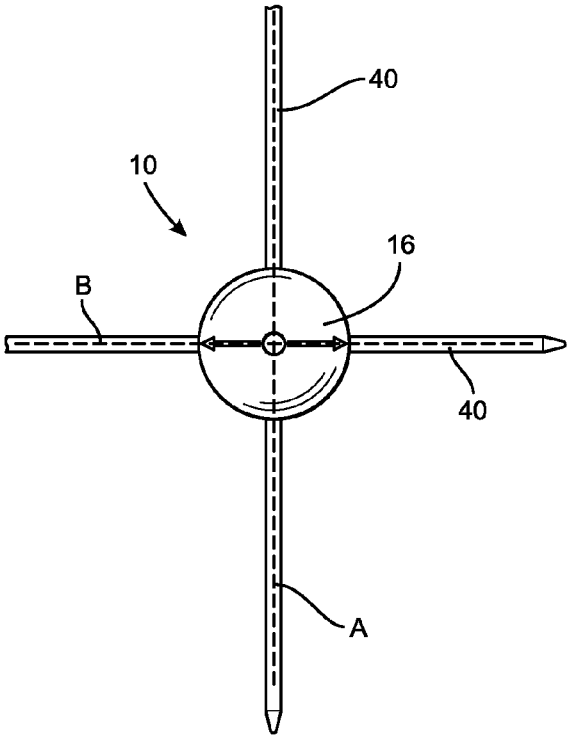
FIG. 6 is a top view of the golf training system of FIGS. 4 and 5 with alignment rods inserted through the target/connecting member.
Figure 7:
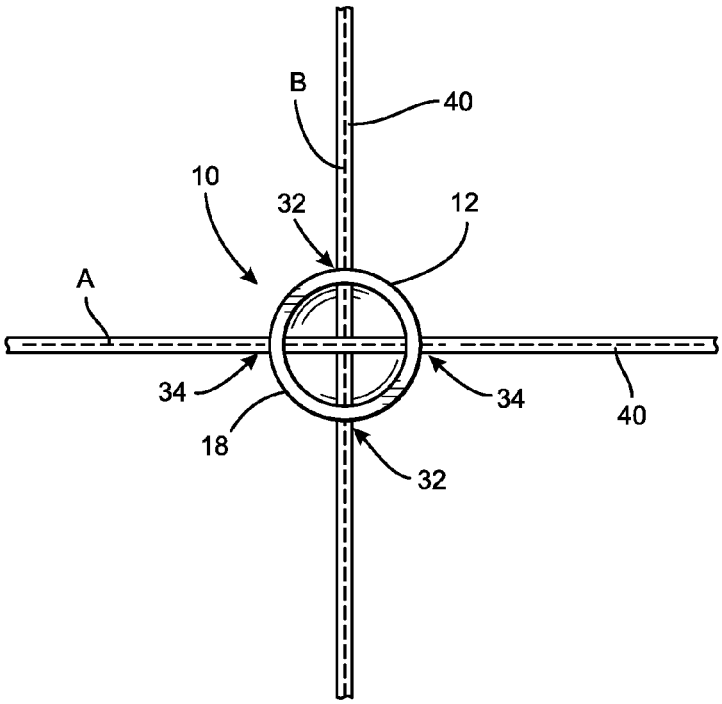
FIG. 7 is a bottom view of the training system of FIG. 6.
Figure 8:
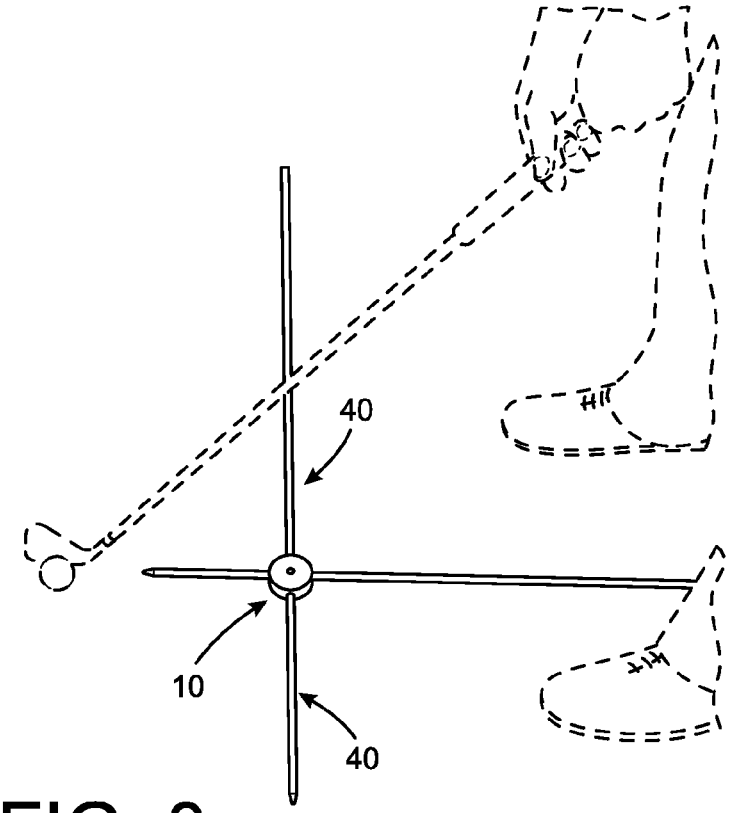
FIG. 8 depicts a method of combining a target/connecting member, such as depicted in FIGS. 4 and 5, with alignment rods to form one type of training aid.

The first and second pair of side openings 32, 34 may be used to insert alignment rods 40 through the target/connecting member 10 as depicted in FIGS. 6 and 7. The alignment rods 40 are long, thin and straight beams or sticks which when inserted through one or both pairs of side openings 32, 34 of a target/connecting member 10 can be used in a variety of different ways as a training tool for practicing, training and/or instructing many different aspects of a golfer's game. One or more alignment rods 40 may be included with one or more target/connecting members 10 as part of a kit, or the components may be provided separately. As depicted in FIGS. 6 and 7, an alignment rod 40 may be inserted through each pair 32, 34 of side openings simultaneously. To allow an alignment rod 40 to be inserted in each pair of openings, 32, 24 simultaneously, the first pair of openings 32 and the second pair of openings 34 are offset vertically from each relative to the perimeter wall 12 as can be seen in FIG. 4.

FIGS. 8-12 depict various ways golf training systems in accordance with the disclosure may be used as training tools and aids for different aspects of a golfer's game. For example, in FIG. 8, a target/connecting member 10 is positioned on the ground with alignment rods 40 extended through each pair of side openings 32, 34. One of the alignment rods 40 is positioned parallel to the shot direction and the other alignment rod is aligned with the golf ball. In this configuration, the alignment rods 40 can be used as a reference for aligning the golfer's stance and positioning the club head, feet, hands, etc.

Figure 9:
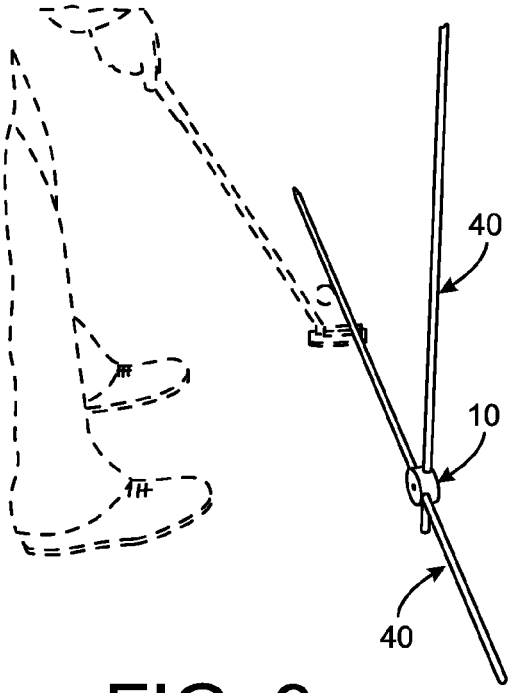
FIG. 9 depicts a method of combining a target/connecting member, such as depicted in FIGS. 4 and 5, with alignment rods to form another type of training aid.

FIG. 9 depicts a target/connecting member 10 with alignment rods 40 extended through each pair of openings 32, 34. In this embodiment, one of the alignment rods is oriented vertically and staked into the ground while the other alignment rod is oriented horizontally and spaced apart from the ground. This results in the target/connecting member 10 being oriented sideways as can be seen in FIG. 9. In this position, the horizontal rod can extend over the ball and be aimed toward a target to provide visual indicator of the path to the hole which the golfer can use to align the swing path of the golf club without interfering with the swing. The position of the target/connecting member 10 can be varied along the alignment rods 40 to provide a variable distance between the ground and the horizontal rod 40 if desired.

Figure 10:
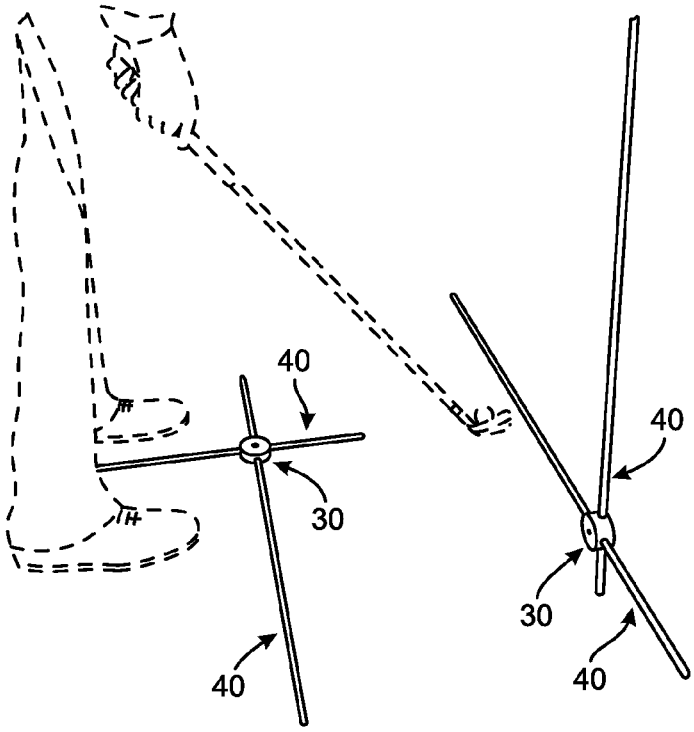
FIG. 10 depicts a method of using target/connecting members and alignment rods, such as depicted in FIGS. 8 and 9, in conjunction with each other to form another type of training aid.
Figure 11:
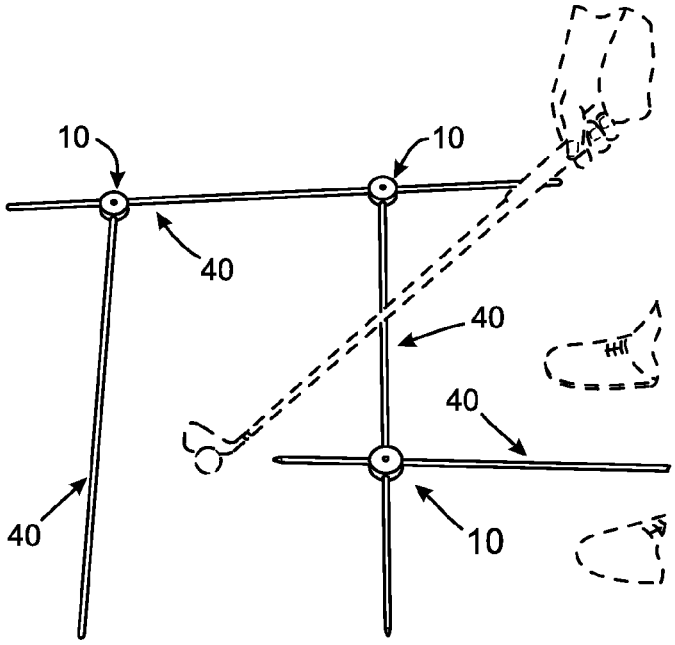
FIG. 11 depicts another method of combining multiple target/connecting members, such as depicted in FIGS. 4 and 5, with alignment rods to form another type of training aid.
Figure 12:
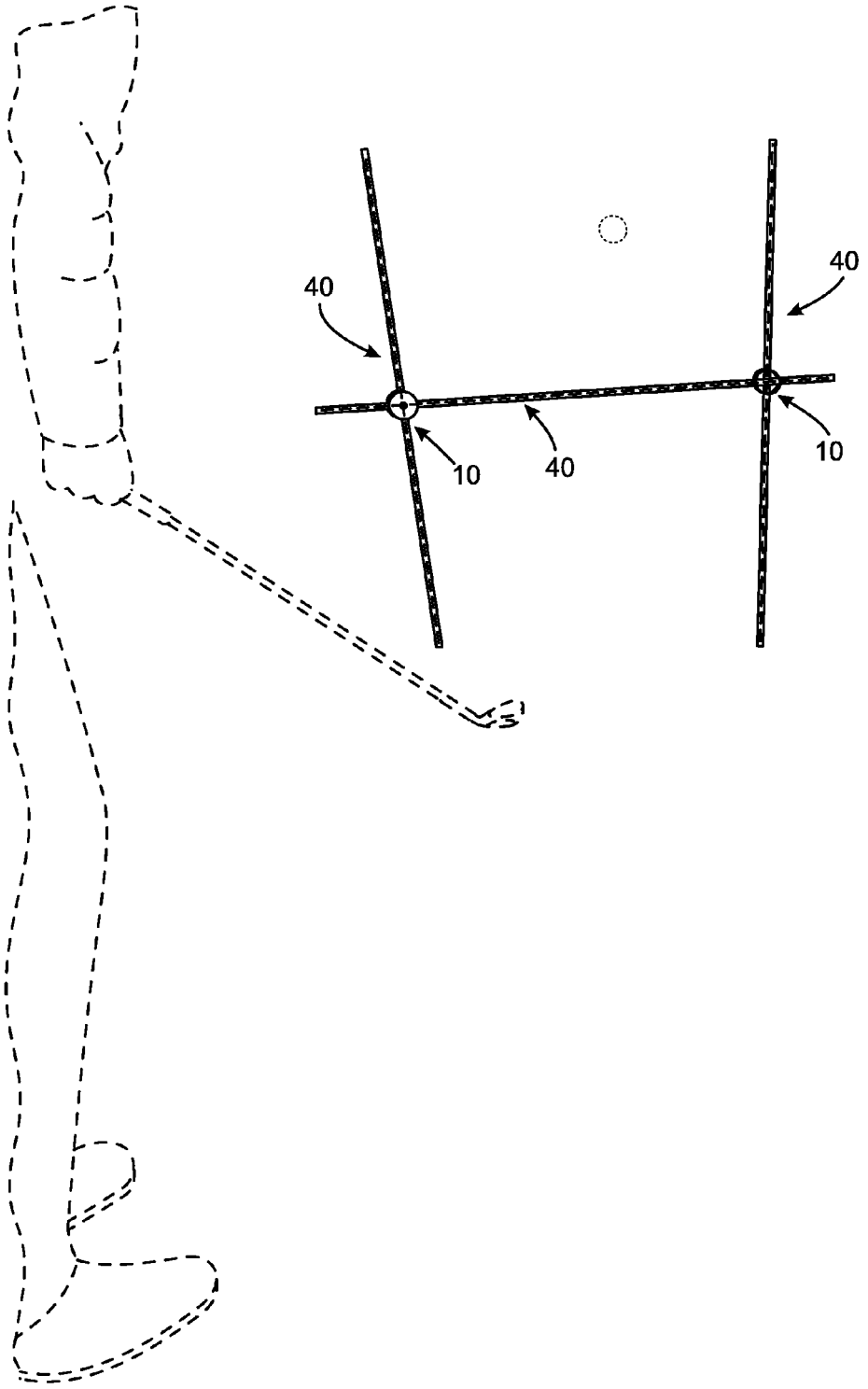
FIG. 12 depicts a method of combining multiple target/connecting members, such depicted in FIGS. 4 and 5, with alignment rods to form yet another type of training aid.

FIGS. 10-12 depict different ways that multiple target/connecting members and alignment rods can be configured to aid in practicing and/or instructing various aspects of a golfer's game. In FIG. 10, a first set of alignment rods 40 and a target/connecting member 10 is arranged in the manner depicted in FIG. 8 and a second set of alignment rods and a target/connecting member 10 is arranged in the manner depicted in FIG. 9. The target/connecting members 10 and alignment rods 40 are used in conjunction to provide a reference for aligning and positioning the golfer and golf club with respect to the golf ball and to provide a reference for aligning the path of the ball and the path of the swing.

FIG. 11 depicts a configuration in which three target/connecting members 10 and four alignment rods 40 are connected and placed on the ground to provide multiple references for positioning and alignment. FIG. 12 depicts the use of two target/connecting members 10 with alignment rods 40 arranged to form a goal post configuration. The horizontal rod can be used as a height target which a golfer can use to practice hitting a golf ball over or under, e.g., with a chip shot. Another possible configuration (not shown) that may be used is to connect a plurality of target/connecting member and a plurality of alignment rods into, for example, a three-by-three grid. The cells in the grid can then be used as targets that a golfer can aim.

The embodiments depicted in FIGS. 8-12 are only a few examples of ways in which golf training systems in accordance with the disclosure can be used as training aids. A person of ordinary skill in the art can readily see that the possible configurations in which target/connecting member and alignment rods can be connected and used as golf training aids is only limited by one's imagination.

Figure 13:
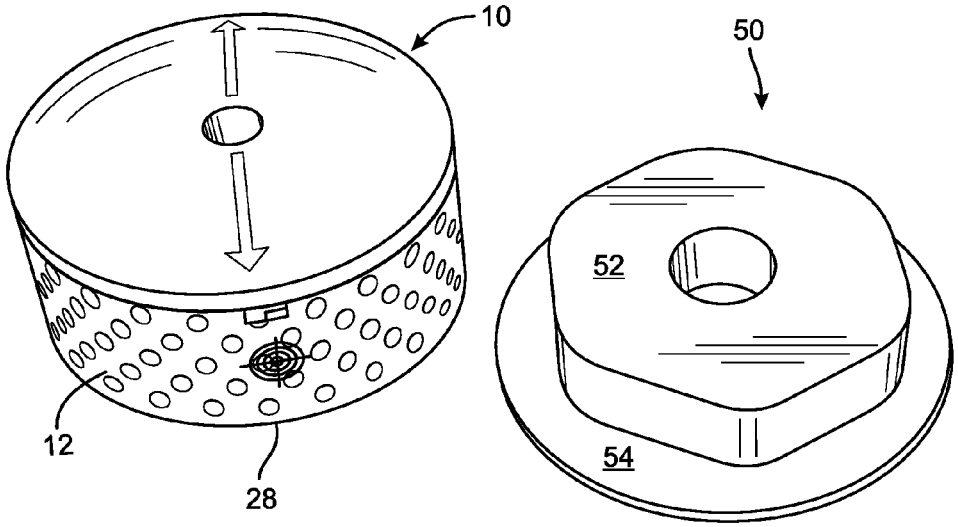
FIG. 13 depicts an embodiment of a golf training system having an anchoring system with the anchoring system removed.
Figure 14:
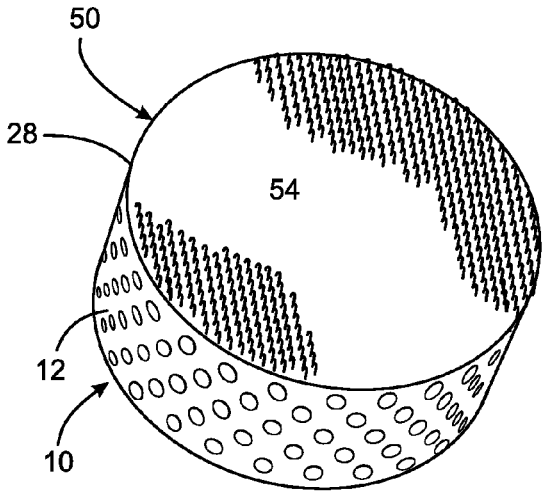
FIG. 14 depicts the golf training system of FIG. 13 with the anchoring system installed.
Figure 15:
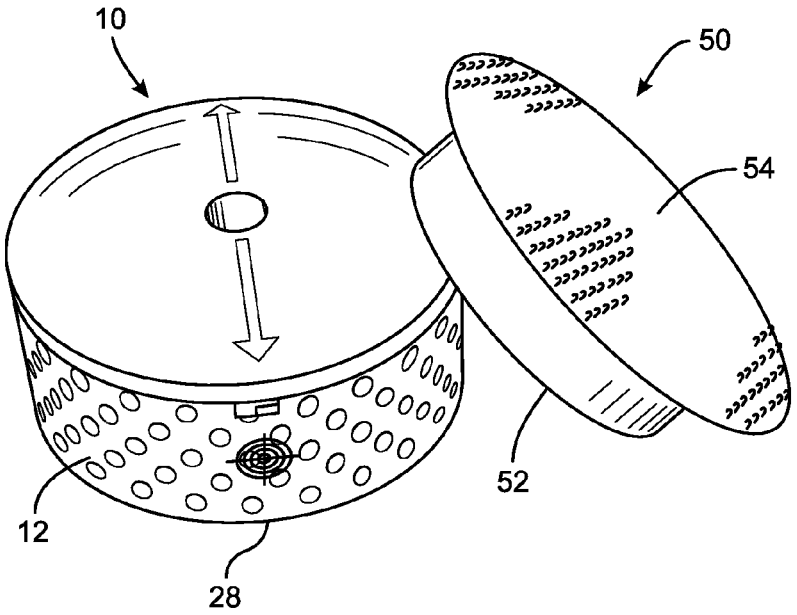
FIG. 15 is another view of the golf training system of FIG. 11 with the anchoring system removed.

Referring now to FIGS. 13-15, a golf training system may be provided with an anchoring system 50 that enables the system to be anchored to surfaces other than grass. This allows a golf training system to be used at locations other than on a golf course or on grass. The anchoring system 50 comprises an insert 52 and an attachment member 54. The insert 50 is configured to be removably attached to the golf target/connecting member 10. The attachment member 54 is secured to the insert 52 and is configured to be removably attached to one or more types of surfaces.

In the embodiment of FIGS. 13-15, the insert 52 is configured to be received in the hollow interior through the open bottom of target/connecting member 10. The insert 52 is sized and shaped to have a friction fit with the inner surface of the perimeter wall 12 of the target/connecting member 10 that is capable of firmly attaching the target/connecting member 10 and the anchoring system 50 together. The insert 52 is formed of a lightweight, flexible material that may be the same or different than the material used to form the target/connecting member 10. In alternative embodiments, other methods of removably attaching the insert 52 to the target/connecting member 10 may be used, including press fit or snap fit engagement and/or fasteners.

The attachment member 54 comprises a thin panel attached to the flat, bottom surface of the insert with a fastening material and/or structure located on the surface of the panel facing away from the insert. In one embodiment, a fastening material having tiny hooks is used that enables the fastening material to be used to secure the target/connecting member onto surfaces having loops, such as carpets. The hooks and loops form a hook-and-loop fastener (also known as Velcro) which can be used to securely attach the target/connecting member 10 to carpets. This in turn allows the target/connecting member 10 to be used indoors or any place where a suitable carpet is provided.

The insert is sized so that it can be completely inserted into the hollow interior of the target/connecting member 10. As can be seen in FIGS. 13 and 15, the attachment member 54 has an outer perimeter that extends beyond the outer perimeter of the insert 52. When the insert 52 is installed in the target/connecting member, as depicted in FIG. 14, the attachment member 54 can sit generally flush against the bottom of the perimeter wall 12 of the target/connecting member 10. This enables the anchoring system 50 to have little to no impact on the dimensions of the target/connecting member or the position and/or orientation of the target/connecting member when used.

Figure 16:
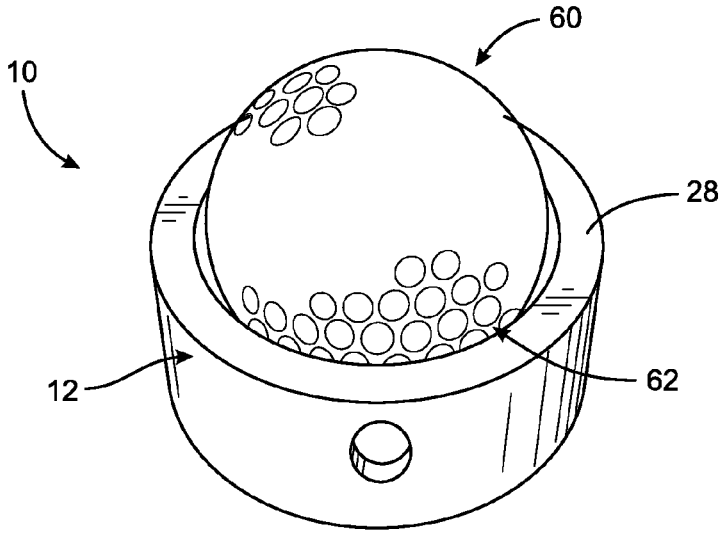
FIG. 16 depicts a bottom view of an embodiment of a golf training aid configured to be used as a ball marking template.

Yet another feature that may be incorporated into the target/connecting member 10 is shown in FIG. 16. In the embodiment of FIG. 16, the target/connecting member 10 is shown being used to provide a reference for marking a straight, center line 62 on the circumference of a golf ball 60. To enable this feature, the interior surface of the perimeter wall 12 has an inner diameter that corresponds closely to the outer diameter of a golf ball, and the distance between the inner surface of the top wall and the bottom edge 28 of the perimeter wall is equal to approximately half the diameter of a golf ball. Thus, when a golf ball is positioned in the hollow interior as depicted in FIG. 16, the bottom edge 28 of the perimeter wall 12 is aligned substantially with the center line of the golf ball. The interior is sized so that the bottom edge 28 of the perimeter wall is adjacent to the outer surface of the golf ball so that a person can easily draw a ring around the golf ball with a pen or marker using the bottom edge 28 as a guide.

A person of ordinary skill in the art can ascertain that the golf training systems described herein can be used as a number of different kinds and types of training aids known in the art, such as the following for example, which lists the common names for the training aids (with the areas in which they are used in parentheses):

1) Ball Liner Stencil (for full swing, pitching, chipping, and putting),
2) Putting String Alignment (putting)
3) Foot Wedge (full swing, chipping)
4) Alignment & Ball Position Station (full swing, pitching, chipping, and putting)
5) Intermediate Target (full swing, pitching, chipping)
6) Putter Shaft Guide (putting)
7) Hand Path Guide (full swing, chipping, pitching)
8) Distance Control Guide (pitching, chipping, and putting)
9) Trajectory Trainer (pitching, chipping)
10) Swing Path Trainer (full swing, pitching, and chipping)
11) Angle of Approach Guide (full swing, pitching, and chipping)
12) Plane Trainer—(full swing, pitching, and chipping)
13) Target Hole (full swing, pitching, chipping, and putting)
14) Cup Reducer (putting)
15) Green Reading Tool (pitching, chipping, and putting)
16) Tempo Station (pitching, chipping, and putting)
17) Games to Enhance Practice Time and Make More Enjoyable (full swing, pitching, chipping, and putting)

The golf training equipment currently available is typically capable of only being used as one type or a limited number of types of training aids from the above list. Therefore, many different pieces of equipment would have to be acquired to provide the same amount and variety of uses as the golf training system presented herein. Golf training equipment is often expensive. As a result, the cost of acquiring all of the golf equipment that would be required to provide the same amount and variety of uses as the golf training system in accordance with this disclosure could be exorbitant when compared to the cost of manufacturing the target/connecting member and alignment rods described herein. In addition, the golf training equipment currently available is often elaborate and/or cumbersome so that transporting and storing all of the golf equipment that would be required to provide the same amount and variety of uses as the golf training system described herein would be impractical and/or prohibitive when compared to the portability of the target/connecting members and alignment rods of the golf training system described herein.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

What is claimed is:

1. A golf training system comprising:

a target/connecting member including:

a top wall defining a central opening, the central opening being sized larger than a shaft of a golf tee and smaller than a head of a golf tee; and a cylindrical perimeter wall extending downwardly from an outer perimeter portion of the top wall, the cylindrical wall and the top wall defining a hollow interior space with an open bottom, the cylindrical wall defining a plurality of openings that extend through the perimeter wall to the hollow interior space, the plurality of openings being spaced apart from each other around a circumference of the perimeter wall, wherein the perimeter wall has a height that is greater than or equal to half the diameter of a regulation-sized golf ball, wherein the cylindrical outer wall portion has a diameter that is less than or equal to a diameter of a regulation-sized golf cup, wherein the plurality of openings include a first pair of openings that are aligned with each other on a first axis that is perpendicular to a center axis of the perimeter wall and intersects the center axis, and wherein the plurality of openings include a second pair of openings that are aligned with each other on a second axis that is perpendicular to the center axis of the perimeter wall and intersects the center axis.

2. The golf training system of claim 1, wherein the first pair of openings and the second pair of openings are offset vertically in relation to each other relative to the perimeter wall.

3. The golf training system of claim 1, wherein the openings are spaced approximately 90° apart from each other about the perimeter wall.

4. The golf training system of claim 1, further comprising:

at least one alignment rod, the alignment rod being configured to be extended through one of the first pair and the second pair of openings, the openings being sized to removably retain the alignment rod when extended therethrough.

5. The golf training system of claim 4, wherein the at least one alignment rod comprises a pair of alignment rods, the pair of alignment rods being configured to be extended through a respective one of the first pair and the second pair of openings.

6. The golf training system of claim 1, further comprising:

a tee support portion that extends from the central opening, the tee support portion including an inner wall that defines a passage configured to receive the shaft of a golf tee extended through the central opening.

7. The golf training system of claim 6, wherein the tee support portion includes a tee retaining structure, the tee retaining structure protruding into the passage from the inner wall, the tee retaining structure being configured to removably retain the shaft of a golf tee within the passage.

8. The golf training system of claim 7, further comprising:

at least one alignment rod, the alignment rod being configured to be extended through one of the first pair and the second pair of openings, the openings being sized to removably retain the alignment rod when extended therethrough.

9. The golf training system of claim 1, further comprising:

an anchoring system configured to be removably attached to a bottom portion of the target/connecting member and configured to be removably attached to a surface.

10. The golf training system of claim 9, wherein the anchoring system includes:

an insert configured to be removably installed in the hollow interior space of the target/connecting member, and an attachment member secured to the insert, the attachment member including a hook type fastening structure that is configured to form a hook-and-loop fastener when placed in contact with a surface having a loop material.

11. The golf training system of claim 10, further comprising:

at least one alignment rod, the alignment rod being configured to be extended through one of the first pair and the second pair of openings, the openings being sized to removably retain the alignment rod when extended therethrough.

12. The golf training system of claim 1, wherein the perimeter wall has an inner diameter that is approximately equal to a diameter of a golf ball, and wherein the perimeter wall extends from the top wall to position a bottom edge of the perimeter wall a predetermined distance from an inner surface of the top wall, the predetermined distance being equal to approximately half the diameter of a golf ball.

13. A golf training system comprising:

at least one target/connecting member including:

a top wall defining a central opening, the central opening being sized larger than a shaft of a golf tee and smaller than a head of a golf tee; and a cylindrical perimeter wall extending downwardly from an outer perimeter portion of the top wall, the cylindrical wall and the top wall defining a hollow interior space with an open bottom, the cylindrical wall defining a plurality of openings that extend through the perimeter wall to the hollow interior space, the plurality of openings being spaced apart from each other around a circumference of the perimeter wall, wherein the perimeter wall has a height that is greater than or equal to half the diameter of a regulation-sized golf ball, wherein the cylindrical outer wall portion has a diameter that is less than or equal to a diameter of a regulation-sized golf cup, wherein the plurality of openings include a first pair of openings that are aligned with each other on a first axis that is perpendicular to a center axis of the perimeter wall and intersects the center axis, and wherein the plurality of openings include a second pair of openings that are aligned with each other on a second axis that is perpendicular to the center axis of the perimeter wall and intersects the center axis, and a plurality of alignment rods each being configured to be extended through the first pair and the second pair of openings, the openings being sized to removably retain the alignment rod when extended therethrough.

14. The golf training system of claim 13, wherein a first one of the alignment rods is extended through and removably retained by the first pair of openings, and wherein a second one of the alignment rods is extended through and removably retained by the second pair of openings.

15. The golf training system of claim 13, wherein the at least one target/connecting member comprises a plurality of target/connecting members, and wherein the plurality of target/connecting members and the plurality of alignment rods are connected together by extending the alignment rods through the first pair and the second pair of openings of the target/connecting members to form a predetermined shape.

16. The golf training system of claim 13, wherein the first pair of openings and the second pair of openings are offset vertically in relation to each other relative to the perimeter wall.

17. The golf training system of claim 13, wherein the openings are spaced approximately 90° apart from each other about the perimeter wall.

* * * * *